United States Patent [19]

Barlow

[11] Patent Number: 4,890,596

[45] Date of Patent: Jan. 2, 1990

[54] ARROW REST

[76] Inventor: William J. Barlow, Rte. 1, Box 504, Norwood, N.Y. 13668

[21] Appl. No.: 229,266

[22] Filed: Aug. 8, 1988

[51] Int. Cl.[4] ..... F41B 5/00

[52] U.S. Cl. ..... 124/41 A; 124/24 R

[58] Field of Search ..... 124/21, 22, 24 R, 26, 124/41 A

[56] References Cited

U.S. PATENT DOCUMENTS

| | | | |
|---|---|---|---|
| 3,871,352 | 3/1975 | Stanislawski et al. . | |
| 4,236,497 | 11/1980 | Troncoso, Jr. . | |
| 4,299,195 | 11/1981 | Norris | 124/24 R |
| 4,398,528 | 10/1983 | Troncoso, Jr. . | |
| 4,489,704 | 7/1984 | Troncoso, Jr. . | |
| 4,492,214 | 7/1985 | Kielhoffer . | |
| 4,662,346 | 6/1987 | Laffin . | |

OTHER PUBLICATIONS

Troncoso, "What's Your Problem", Archery, Jul. 1973, p. 4.

*Primary Examiner*—Randolph A. Reese
*Assistant Examiner*—Anthony Knight
*Attorney, Agent, or Firm*—Wall and Roehrig

[57] ABSTRACT

An arrow rest for a compound bow having an arrow window. The rest includes a first coil spring positioned in the window and having its outer coil bent outwardly for supporting engagement of an arrow. A second coil spring is also positioned in the window so as to coact with the first spring to support the arrow, the second spring also having its outer coil bent outwardly for this purpose. The second spring is normally positioned below the first spring and is obliquely disposed with respect to it. The support assembly for the second spring includes four adjustments for precisely establishing the spacing and angular adjustment between the springs.

1 Claim, 1 Drawing Sheet

ARROW REST

BACKGROUND OF THE INVENTION

This invention relates generally to the sport of archery and has particular reference to an improved arrow rest for an archery bow.

Many years ago the sport of archery was practiced with a long bow of relatively simple construction, and the arrow nock was held in engagement with the bowstring and the latter was drawn back by one hand while the archer grasped the bow handle with his other hand. When shooting with the old long bow, the portion of the arrowforward of the nock was generally supported in shooting position by resting it on the upper part of the archer's hand holding the bow handle.

With the advent of the more sophisticated recurved and compound bows, and the present highly technical approach to archery, bows are constructed with arrow windows so that the bow itself does not obstruct the most desirable path for the arrow. This window is normally spaced above the handle portion of the bow so that it is no longer possible to support the arrow forward of the nock on the hand that is gripping the bow handle. This has led to the provision in most modern bows of some type of a mechanical arrow rest in the arrow window. In addition to supporting a portion of the arrow, these rests must make provision for the passage of the arrow vanes or feathers through the rest and various other factors in scientific shooting must be considered.

A number of different arrow rests are disclosed in the following U.S. Patents noted in the course of a preliminary search: U.S. Pat. Nos. 3,871,352; 4,236,497; 4,398,528; 4,489,704; 4,492,214 and 4,662,346. Of these, U.S. Pat. No. 4,236,497 to F. V. Troncoso, Jr. is the closest prior art in the applicant's opinion. The arrow rest shown in FIGS. 1 and 2 of the Troncoso patent, like the present invention, employs a pair of springs to support the arrow. However, the springs in the patent are colinear whereas the springs of the rest disclosed herein are obliquely disposed with respect to one another which, together with their supporting structure, enables greater latitude in adjusting the spacing and angular adjustment between the springs as will become apparent from the following detailed description.

SUMMARY OF THE DESCRIPTION OF THE INVENTION

The arrow rest of the invention is particularly adapted for use with a compound bow having an arrow window that is defined in part by an arrow shelf and a vertical sidewall. The rest includes a first coil spring that is connected to the sidewall and projects into the arrow window, the outer coil of the spring being bent outwardly for supporting engagement with the shaft of an arrow. A second coil spring is also positioned in the arrow window by adjustable supporting means, the spring being adapted to coact with the first coil spring to support the arrow and having its outer coil bent outwardly for this purpose. The second spring is normally positioned below the first spring and is obliquely disposed with respect to it, and the supporting means for the second spring includes four different adjustments for precisely establishing the spacing and angular adjustment between the springs whereby a wide variety of arrows with different characteristics can be accommodated.

DESCRIPTION OF THE PREFERRED EMBODIMENT

Figure 1:
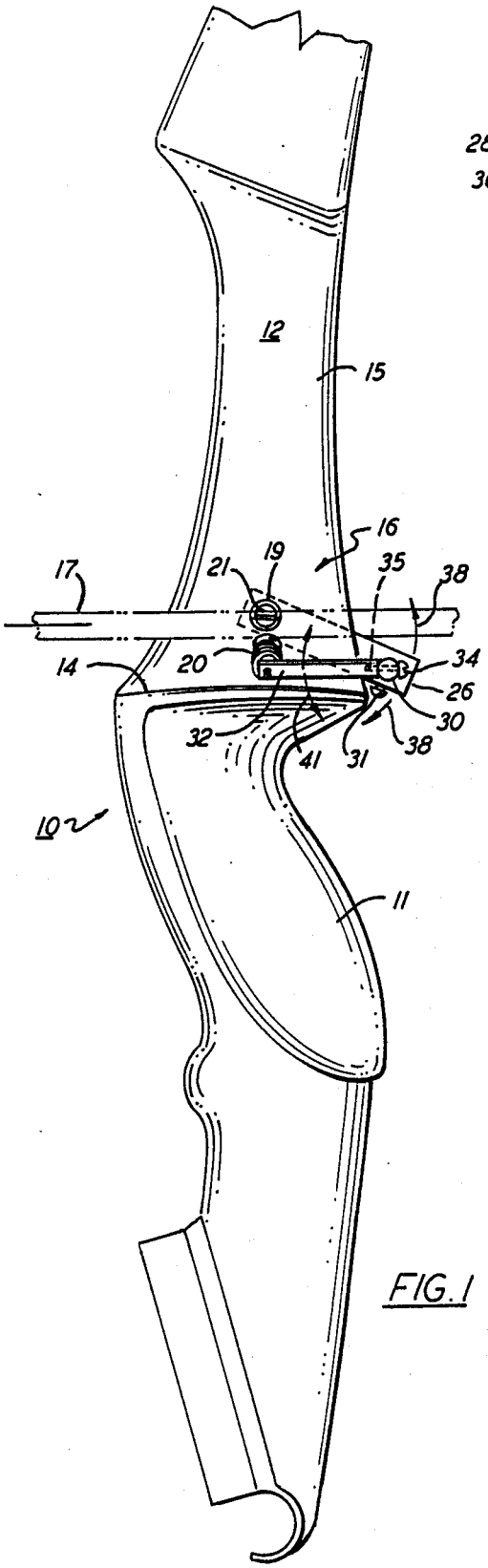
FIG. 1 is a right side elevation of the arrow rest of the invention mounted on a compound bow that is shown fragmentarily.

Having reference now to the drawings, 10 generally indicates the central portion of a compound bow having a handle 11 and an arrow window 12, the window being defined by an arrow shelf 14 and window sidewall 15. The arrow rest, generally referenced at 16, is located in the window 12 and operates to support the shaft of an arrow shown partially at 17 in FIG. 1. In FIG. 1 the front of the bow is on the left and the arrow nock and bowstring (neither of which is shown) are on the right.

Figure 3:
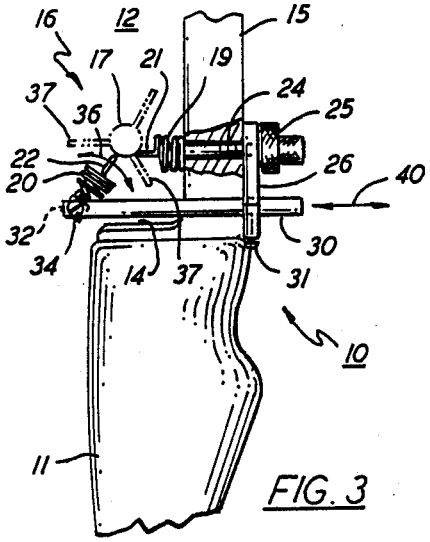
FIG. 3 is a rear elevation of the arrow rest.
Figure 4:
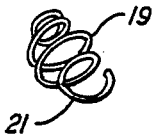
FIG. 4 is an enlarged perspective view of one of the coil springs.

The arrow rest 16 includes a pair of relatively short coil springs 19 and 20 which coact to support the arrow as best shown in FIG. 3. The outer coils 21, 22 of the springs are bent outwardly FIGS. 3 and 4, and these engage and support the arrow shaft. Spring 19 is fixed at its inner end to a shaft 24 that passes through the sidewall 15 and beyond where a knurled nut 25 secures the shaft and spring in position with outwardly bent coil 21 of the latter lying in a substantially horizontal plane.

Figure 2:
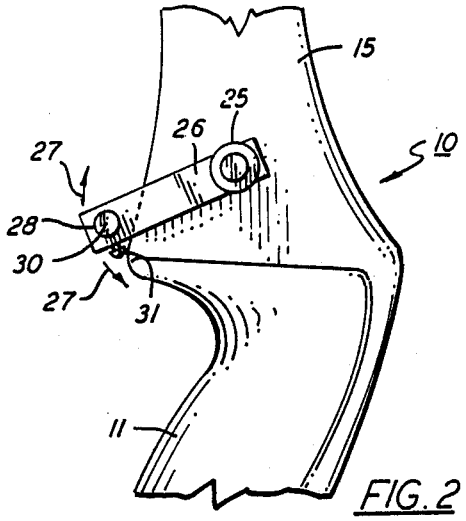
FIG. 2 is a left side elevation showing a portion of the supporting structure for the arrow rest.

Between the sidewall 15 and nut 25 the shaft passes with a free fit through a hole in one end of a mounting plate 26. The angular position of this plate is adjustable as indicated by arrows 27 in FIG. 2, and after the plate has been moved into a desired position of adjustment it is secured in that position by tightening nut 25. The opposite end of mounting plate 26 is also provided with an untapped hole 28 in which one end of a rod element 30 is received. The position of the rod 30 can be adjusted both axially and rotationally and after having been moved into a desired position of adjustment the rod can be secured in such position by a set screw 31, FIGS. 2 and 3.

The opposite end of rod 30 is connected to a bar member 32, FIG. 1, as by a screw 34 that passes with a free fit through a transverse hole in the rod and is threaded into ân axial bore 35 in one end of the bar member as best shown in FIG. 1. Coil spring 20 is secured to the other end of the bar member 32 with its axis being disposed at substantially right angles to the axis of the bar member. The bar member is dimensioned so that spring 20 is located opposite spring 19 as best shown in FIG. 1, e.g. the axis of the springs are substantially coplanar.

Bar member 32 can be rotationally adjusted to move the outer coil 22 of spring 20 closer to or father from the outer coil 21 of spring 19 as is indicated by the arrows 36 in FIG. 3. To facilitate this angular adjustment, the bar member preferably has a polygonal cross section, a square cross section being shown in the drawings. After the bar member has been rotated into the desired position of adjustment it is held in that position by tightening the screw 34.

As may be seen from the drawings and preceding description, coil spring 20 is directed toward but spaced from spring 19 whereby their outwardly bent coils 21 and 22 coact to support the arrow shaft as best shown in FIG. 3. In accordance with the invention, spring 20 is also positioned somewhat below spring 19 and its axis is obliquely disposed with respect to that of spring 19. This arrangement permits precise adjustment of the spacing and angular adjustment between the springs which is necessary because there are a large variety of arrows having different characteristics that are used for hunting and target shooting. Thus, for example, the vanes or feathers 37 of the arrow, FIG. 3, must be able to pass through the rest in unobstructed fashion or that the rest does not in any way interfere with the flight of the arrow. Some other factors that must be considered are the diameter and weight of the arrow shaft, the length of the arrow and so forth.

The spacing and angular adjustments referred to above are four in number. Thus, the angular position of mounting plate 26 can be adjusted as indicated by arrows 38 and 27 in FIGS. 1 and 2 to determine the height or vertical position of the rod element 30. The rod element itself can be adjusted axially as indicated by arrows 40, FIG. 3, and rotationally or angularly as shown by arrows 41, FIG. 1. Lastly, the angular relation between coil springs 19 and 20 can be varied as indicated by arrows 36, FIG. 3.

From the foregoing description it will be apparent that the invention provides an improved arrow rest having a relatively simple construction yet one that permits precise adjustment so that a wide variety of arrows can be accommodated. As will be understood by those familiar with the art, the invention may be embodied in other specific forms without departing from the spirit or essential characteristics thereof.

What is claimed:

1. The arrow rest for an archery bow that includes:

an arrow window defined by an arrow shelf and a vertically disposed sidewall, a first coil spring connected to the bow sidewall and projecting into the arrow window, said first coil spring having its outer coil bent to slidably support a shaft of an arrow thereon, an elongated support arm removably connected at one end to the bow sidewall on the side thereof opposite the arrow window, a rod element slidably mounted in the outer end of said mounting support arm, said rod element being spaced from the bow sidewall and being disposed at substantially right angles to the support arm, a bar member having a circular section rotatably secured at its proximal end in said outer end of said rod element for rotation about its own axis, said bar member being disposed so as to extend into the arrow window, a second coil spring mounted on the distal end of said bar member to form a gap between said first and second coil springs, said second coil spring having its outer coil bent outwardly to slidably support the shaft of said arrow thereon whereby the shaft is supported between the two springs, said support arm, said rod element and said bar member providing three directions of adjustment to said second coil spring in reference to said first coil spring to position said second coil spring obliquely below said first coil spring in arrow supporting relationship to enable a feather on the back of said shaft to pass freely through the gap between the coil springs.

* * * * *